US006415802B1

(12) United States Patent
Clixby et al.

(10) Patent No.: US 6,415,802 B1
(45) Date of Patent: Jul. 9, 2002

(54) ACID ETCHING MACHINE

(75) Inventors: Dennis Clixby, Maumee; Glenn Pocock, Toledo, both of OH (US)

(73) Assignee: CD Holdings, Inc., Toledo, OH (US)

( * ) Notice: Subject to any disclaimer, the term of this patent is extended or adjusted under 35 U.S.C. 154(b) by 0 days.

(21) Appl. No.: 09/565,947

(22) Filed: May 5, 2000

(51) Int. Cl.[7] ..... B08B 3/00

(52) U.S. Cl. ..... 134/80; 134/57 R; 134/58 R; 134/140; 134/157; 156/345

(58) Field of Search ..... 156/345; 134/56 R, 134/57 R, 58 R, 61, 66, 76, 78, 79, 80, 117, 119, 137, 140, 157, 201

(56) References Cited

U.S. PATENT DOCUMENTS 5,505,311 A * 4/1996 Kronseder et al. ..... 209/522
5,666,985 A * 9/1997 Smith et al. ..... 134/102.2
5,804,507 A * 9/1998 Perlov et al. ..... 134/33
6,048,162 A * 4/2000 Moslehi ..... 414/217
6,139,406 A * 10/2000 Kennedy et al. ..... 451/28

* cited by examiner

*Primary Examiner*—Randy Gulakowski
*Assistant Examiner*—Joseph Perrin
(74) *Attorney, Agent, or Firm*—Marshall & Melhorn, LLC

(57) ABSTRACT

An automated acid etching machine for glass and ceramic items includes a plurality of horizontal arms rotatable about a central hub, a vertically translatable arm attached to each of the horizontal arms, a carrier head attached to each of the vertically translatable arms, and item gripping means located on the carrier head. Treatment stations are circumferentially located about the hub. After the items are secured by a gripper, the horizontal arm indexes to the first treatment station, and the vertically translatable arm inserts and then retracts the items into the treatment station. The items are indexed among the plurality of stations until the etching process is complete. The stations have slotted roofs allowing the carrier heads to index from station to station without completely exiting the structure. Items secured to each of the carrier heads are treated in the various different treatment stations simultaneously.

15 Claims, 4 Drawing Sheets

ACID ETCHING MACHINE

BACKGROUND OF THE INVENTION

The present invention relates to an automated acid etching machine for simultaneously utilizing a plurality of treatment stations to etch glass and ceramic items, especially containers. For the purposes of this invention, such items may include architectural pieces, residential pieces or tableware, which includes but is not limited to, bottles, jars, glasses, mugs, cups, goblets, tumblers, flutes, or any other similar type item capable of being chemically etched.

The use of machines to assist in the etching of glass and ceramic items is well known. Previous machines consisted of several linearly arranged treatment stations. These machines often only allowed one treatment station to be used at a time, required that the items be loaded and unloaded at the same station, and could not etch more than a few items at a time. Previous machines also often required human assistance in loading or unloading items or to perform various other tasks during the etching process. Human participation in the etching process often introduced decreased efficiency in the etching process and exposed workers to hazardous etching chemicals and fumes.

Therefore, a need exists for an acid etching machine capable of simultaneously utilizing a plurality of treatment stations for etching glass and ceramic items. Additionally, a machine capable of loading and unloading items at separate stations is needed to maximize the number of items which may be etched. Lastly, an acid etching machine is needed which automates the etching process as practically as possible and which minimizes, or eliminates, workers' exposure to etching chemicals and fumes. The present invention overcomes the drawbacks and disadvantages of the prior art.

SUMMARY OF THE INVENTION

The invention is an automated acid etching machine for glass and ceramic items. The machine comprises a plurality of horizontal arms rotatable about a central hub, a vertically translatable arm attached to each horizontal arm, a carrier head attached to each vertically translatable arm, item grippers attached to each carrier head, and a plurality of treatment stations circumferentially located about the hub.

The items arrive by conveyor means at a load station and are subsequently transported through stations comprising a surface treatment removal station, washing stations, a conditioning station, etching stations, an acid dip station, a caustic dip station, a drying station, and lastly, an unload station.

To load the items into the machine, a horizontal arm indexes to the load station. The vertically translatable arm is positioned opposite the items. The item grippers engage the items in fluid tight gripping contact, the vertically translatable arm removes the items from the conveyor and the items are indexed to the next station. The vertically translatable arm is equipped with piston means which allows the head, and therefore the attached items, to be immersed and subsequently removed from the various stations. The immersion and removal of the items is preferably controlled by programmable computer means.

The central support hub assists in transporting and distributing fluid to and from the arms and the gripping devices. A series of computer controlled pilot valves, solenoids and conduits assists in this process. The hub also functions as a supportive central attachment point to each of the horizontal arms.

The circular design of the treatment stations, in addition to the rotating central hub, the plurality of vertically translating arms, and the item gripping means, provides the advantage of allowing a number of treatment stations to be used simultaneously. A further advantage of the present invention is the automated transportation of items through the entire etching process, thereby reducing human contact with the etchant solutions and their fumes.

DETAILED DESCRIPTION OF THE PREFERRED EMBODIMENT

It is to be understood that the specific structures and processes illustrated in the attached drawings, and described in the following description are simply exemplary embodiments of the inventive concepts defined in the appended claims. Hence, specific dimensions and other physical characteristics relating to the embodiments disclosed herein should not be considered as limiting, unless the claims expressly state otherwise.

Figure 1:
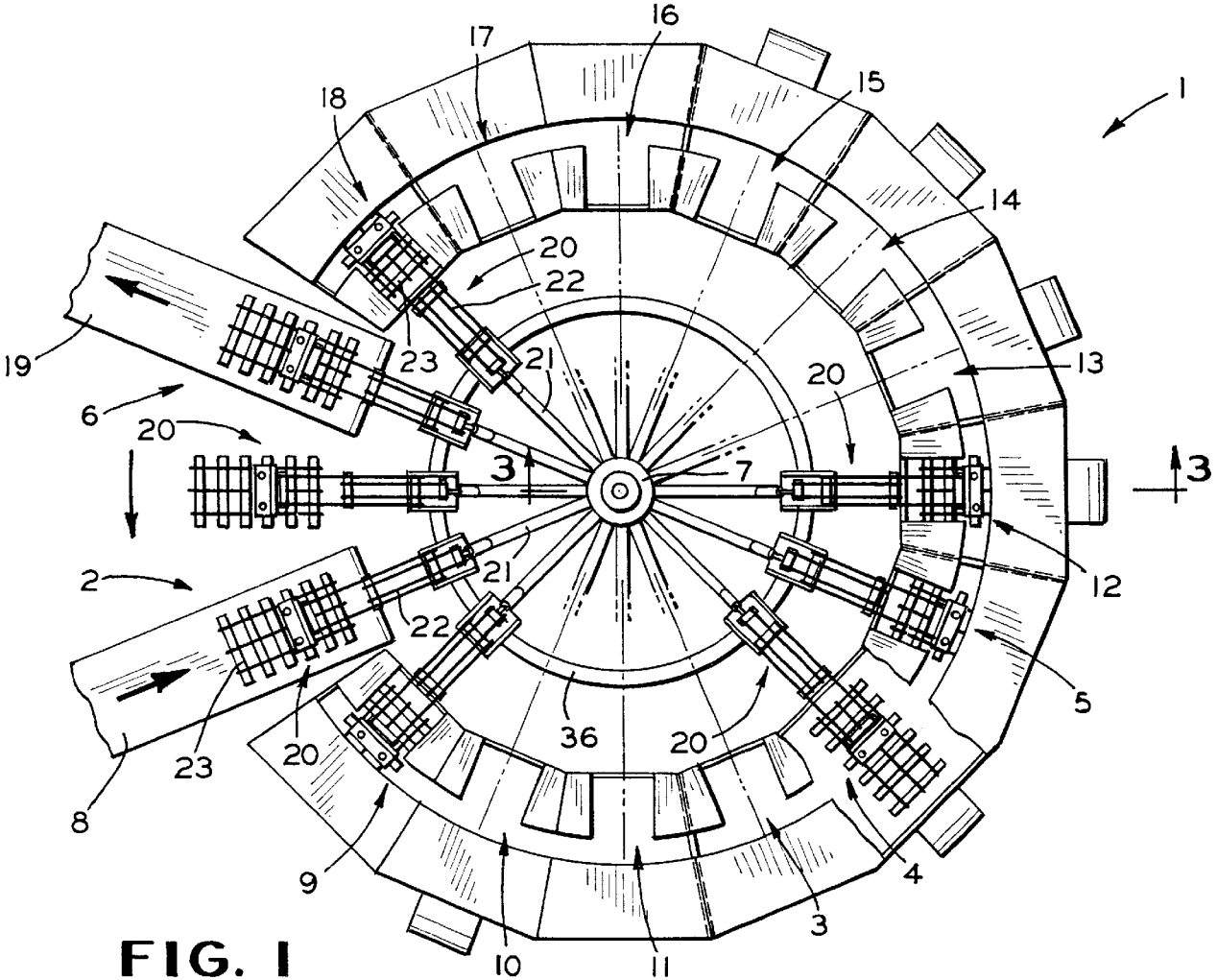
FIG. 1 is a top, plan view, with portions broken away, of an automated acid etching machine in accordance with the present invention.

Referring now to the drawings, FIG. 1 depicts an automated acid etching machine 1 comprising loading 2, etching 3–5 and unloading 6 stations circumferentially located about a central hub 7. In the preferred embodiment, a plurality of additional treatment stations and work areas are also circumferentially located about the central hub 7 in a side-by-side relationship to assist in the etching process. Although the following description recites the preferred arrangement for the various treatment stations and work areas, it can be readily understood by those skilled in the art that various acid etching processes may involve slightly different stations, or stations in a slightly different order.

In the preferred embodiment, unetched items arrive at a load station 2 by conveyor means 8. A first work area (not shown) may be located between the load station 2 and a first treatment station 9. A second work area (not shown) may be located between the load station 2 and the unload station 6. The work areas may be used to provide access to the machine 1 or for workers or machinery to assist in loading or unloading items. Preferably, each of the work areas are at least the width of 2 to 3 treatment stations combined.

A first treatment station 9, preferably located immediately adjacent the first work area, includes a surface treatment removal bath for removing surface contaminants from the items. A second station 10 includes a spray wash to remove treatment solution remaining on the items from the first station 9. A third station 11 conditions the items with a pre-etchant solution before they enter the etchant stations. A fourth 3, fifth 4, and sixth 5 station are etching stations which share a common etchant tank. A water submersion tank is provided at a seventh station 12 for removing etchant adhering to the items. An eighth station 13 comprises an acid solution for removing any etchant remaining on the items. A water submersion tank is provided at a ninth station 14 to remove acid adhering to the items from the eighth station 13.

A tenth station 15 removes resists from the surfaces of the items with a caustic solution. An eleventh 16 and twelfth station 17 spray wash the items to remove any remaining treatment solutions. A thirteenth station 18 houses a blower to remove water adhering to the items before they exit the acid etching machine 1. The last station provides an unloading station 6 for removing the items from the machine 1 and placing them, for example, on a conveyor 19.

A plurality of arm assemblies 20 are also depicted in FIG. 1. In the preferred embodiment, an arm assembly 20 is comprised of a horizontal arm 21 rotatable about the central hub 7, a vertically translatable arm 22 secured to the horizontal arm 21, and a carrier head 23 attached to each vertically translatable arm 22.

Figure 2:
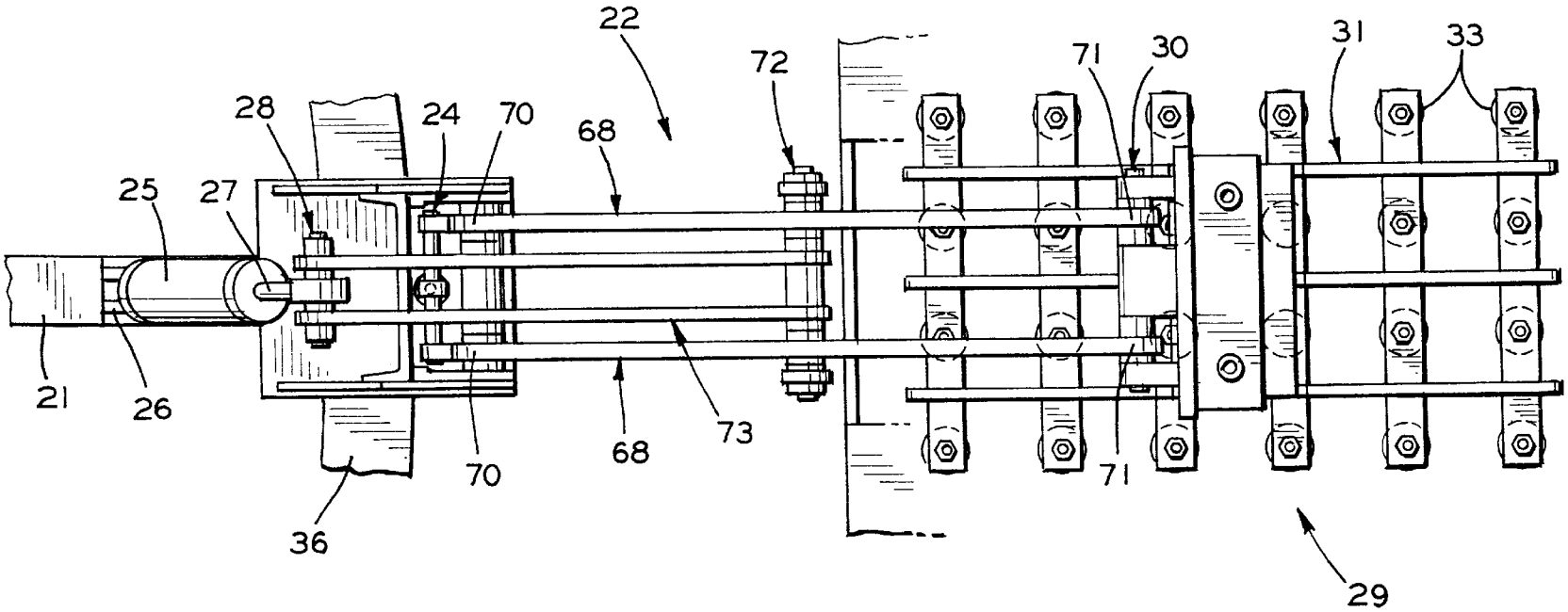
FIG. 2 is an enlarged top, plan view of a portion of the machine shown in FIG. 1.
Figure 3:
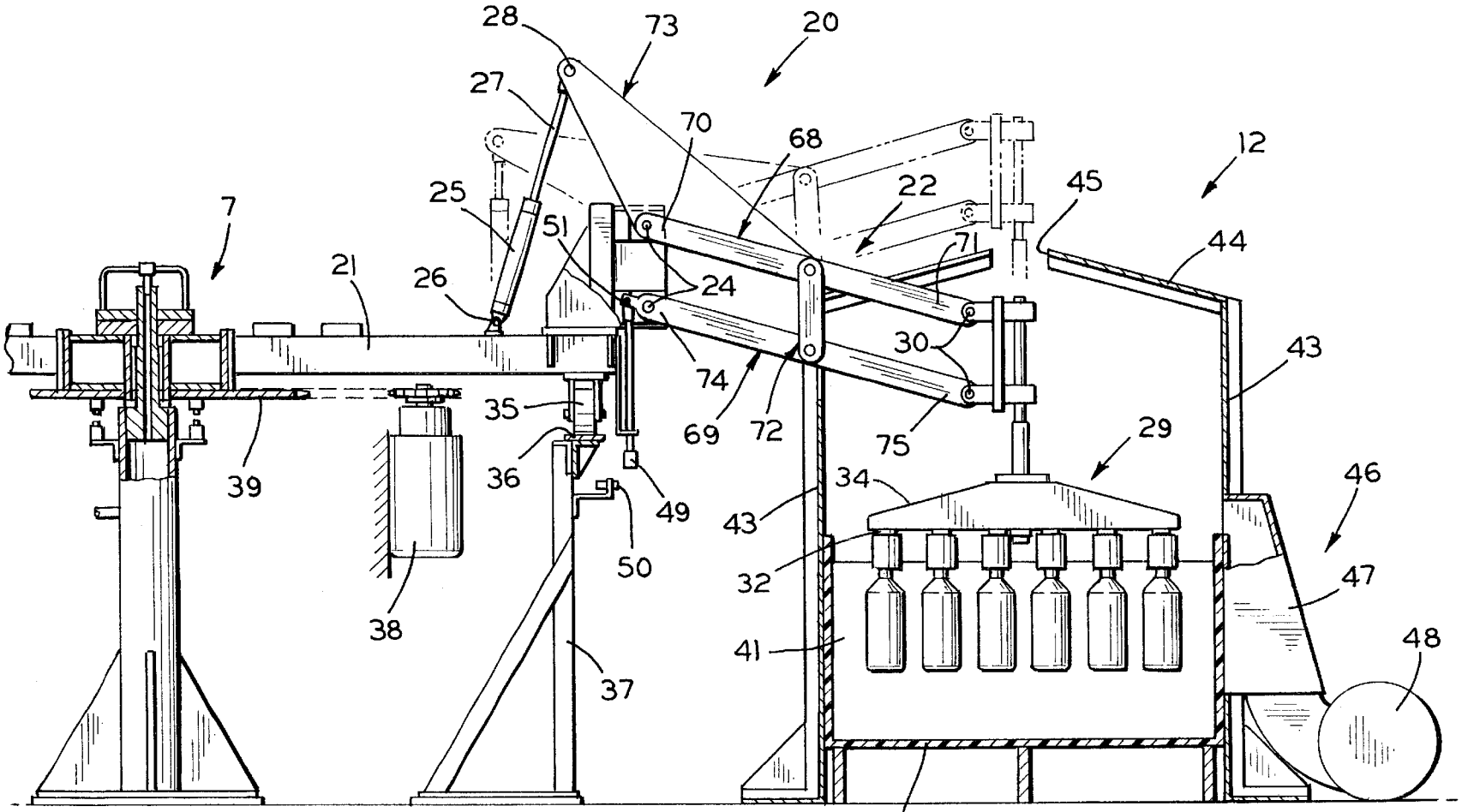
FIG. 3 is a sectional view along line A—A of FIG. 1 depicting a horizontal arm, a vertically translatable arm, a central hub and a treatment station.

FIGS. 2 and 3 depict an arm assembly 20 in further detail. In the preferred embodiment, the arm assembly 20 is attached to the central hub 7 through attachment of the the horizontal arm 21 to the central hub 7. Alternative means for attaching the arm assembly 20 to the central hub 7 include replacing the plurality of horizontal arms 21 with a single flat plate (not shown). The plate is fixed to the central hub 7 and extends radially outward from the hub 7. The vertically translatable arms 22 may then be attached along the circumference or perimeter of the plate.

As depicted in FIGS. 2 and 3, the vertically translatable arm 22 is preferably constructed of a pair of upper members 68 and a pair of lower members 69, each with a first end 70, 74 respectively, and a second end 71, 75 respectively. The pair of upper members 68 and the pair of lower members 69 are pivotally attached at their first ends 70, 74 to the horizontal arm 21, such as by the bolt assembly 24. The upper 68 and lower members 69 are also pivotally attached at their second ends 71, 75 to the carrier head 29, such as by the bolt assembly 30. The upper members 68 and the lower members 69 are connected by a spacer 72 so as to ensure coordinated vertical motion between the members 68 and 69.

Proximate the attachment of the upper member 68 and the lower member 69 to the horizontal arm 21, a piston 25 is pivotally attached to the horizontal arm 21, such as by the bolt assembly 26. A driven portion 27 of the piston 25 is pivotally attached to a driven member 73 of the vertically translatable arm 22, such as by the bolt assembly 28. The driven member 73 is also attached to the spacer 72. Preferably, the piston 25 is driven by pressurized fluid means.

In an alternative embodiment, vertical translation may be provided to the arm 22 with a rotatable threaded shaft (not shown) attached to the horizontal arm 21 and threaded through the vertically translatable arm 22. Depending upon the direction of rotation of the shaft, the threads raise or lower the vertically translatable arm 22. Yet another embodiment for providing vertical translation may include a scissor lift mechanism (not shown) attached to the horizontal arm 21 and the vertically translatable arm 22. Upon engagement, the lift would raise or lower the vertically translatable arm 22 as needed during the etching process.

In the preferred embodiment illustrated, a single vertically translatable arm 22 is attached to each horizontal arm 21. However, it can be readily understood by those skilled in the art that more than one vertically translatable arm 22 may be attached to each horizontal arm 21 in order to transport more items or adapt to various treatment station configurations.

A carrier head 29 is pivotally attached to the vertically translatable arm 22 opposite the piston means 25, such as by the bolt assembly 30. The carrier head 29 is comprised of a frame 31, a plurality of adaptors 32 mounted to the underside of the frame 31 in a spaced-apart array and a gripper 33 attached to each of the adaptors 32. In the preferred embodiment, a fluid manifold 34 for transporting fluid from a fluid source to the individual grippers 33 is also attached to the carrier head 29. The adaptors 32 have a conduit (not shown) passing through their longitudinal axis capable of transporting fluid to and from the grippers 33.

The grippers 33 may be any suitable type of gripping device which can selectively and securedly grip the items to be etched. Examples of suitable gripping devices include, but are not limited to, friction fit devices, suction devices, and jaw-type devices. Preferably, the grippers 33 consist of a connection portion and an inflatable bladder portion. The connection portion connects the gripper 33 to one of the plurality of adaptors 32 secured to the carrier head 29. Preferably, the connection portion and the adaptors 32 have complimentary threaded surfaces for engagement of the connection portion and the adaptors 32 in a fluid tight manner. Although threaded surfaces are the most preferred method for attachment, it can be readily understood that any means which allows rapid attachment and detachment of the grippers 33 may preferably be used. The connection portion is preferably constructed of a polypropylene material to resist the chemical environment encountered during etching, and to prevent damage to the items during inadvertent gripper 33 contact with the items. The bladder portion is constructed of a deformable material which expands into fluid tight gripping contact with a item. Preferably, the bladder is constructed of a rubber-like elastomer and formed in a cylindrical shape to assist in gripping primarily cylindrical items.

The arm 22, carrier head frame 31 and manifold 34 are preferably constructed of a material which resists the chemical environment encountered during etching. Most preferably, they are constructed of a polypropylene material.

FIG. 3 depicts the preferred embodiment for supporting the horizontal arm 21 for rotation about the hub 7. A wheel 35 is fixed to the underside of each horizontal arm 21. The wheel 35 travels along a circular track 36 located radially inwardly of the treatment and work stations. The track 36 is supported by a plurality of support members 37.

An alternative embodiment for supporting the horizontal arm 21 for rotation about the hub 7 is the use of rollers fixed to the underside of each horizontal arm 21.

The horizontal arm 21, central hub 7 and support members 37 are preferably constructed of a material capable of withstanding the chemical environment of glass etching. Most preferably, they are constructed of stainless steel coated with an epoxy paint.

FIG. 3 also depicts the preferred embodiment for imparting a rotational motion to the arm assemblies 20 of the acid etching machine 1. A rotational drive means, preferably an electric motor 38, is mechanically connected to a sprocket 39 attached to the central hub 7. The motor 38 is preferably controlled by a computer network (not shown) which monitors the plurality of sensing systems (described below) to either engage the motor 38 and index the horizontal arms 21 to the next station, or to maintain the arms 21 in their current positions.

Computer controlled electric motors are the preferred method for imparting rotational motion to the acid etching machine 1, although it can be readily understood by those skilled in the art that other means may be used. Alternative rotational means may include, but are not limited to, a manual crank attached by reduction gearing to the machine 1, or a motor which is engaged and disengaged manually rather than through a computer network. Yet another example of an alternative may include the use of pressurized fluid to impart a rotational motion to the machine.

The computer network may also be utilized to control the independent immersion and retraction of the vertically translatable arms 22 (described below), the distribution of fluid pressure (described below) and to monitor the overall etching process.

FIG. 3 provides a cut-away side view of a typical treatment station 12 of the machine 1. The treatment station 12 is comprised of a wall separating the individual tanks 41, a bottom portion 42, side walls 43 and a roof portion 44. The wall 41 restricts the flow of fluids between tanks, however, its height does not prohibit the carrier head 29 and the attached items from indexing between the stations in the retracted, or raised, position. The side walls 43 act to enclose the stations and support the roof 44. A slot 45 is provided at the peak of the roof of each station 44 thereby forming a continuous opening around the circumference of the acid etching machine 1. The slot 45 allows the carrier heads 29 to index between stations without exiting the stations.

As further shown in FIG. 3, an exhaust system 46 is provided for exhausting the etching fumes from an individual station 12. The exhaust system 46 is comprised of a duct 47 leading from the treatment station 12 to an exhaust fan 48. The fan 48 pulls the fumes from the treatment station and drives them through additional ductwork (not shown) away from the machine 1.

FIG. 3 also depicts an actuator 49 located opposite the carrier head 29 on the vertically translatable arm 22 and a proximity lifting sensor 50 located on the support member 37. The actuator 49 is pivotally attached to the vertically translatable arm 22 by, for example, a suitable bolt assembly 51. As a result, when the arm 22 is in the lowered position the arm 22 retracts the actuator 49 out of range of the sensor 50. On the other hand, when the arm 22 is in the raised position, the actuator 49 is within sensing range of the sensor 50. Reading the presence, or absence, of the actuator 49, the sensor 50 transmits to the computer network a signal identifying the position of the vertically translatable arm 22.

Figure 4:
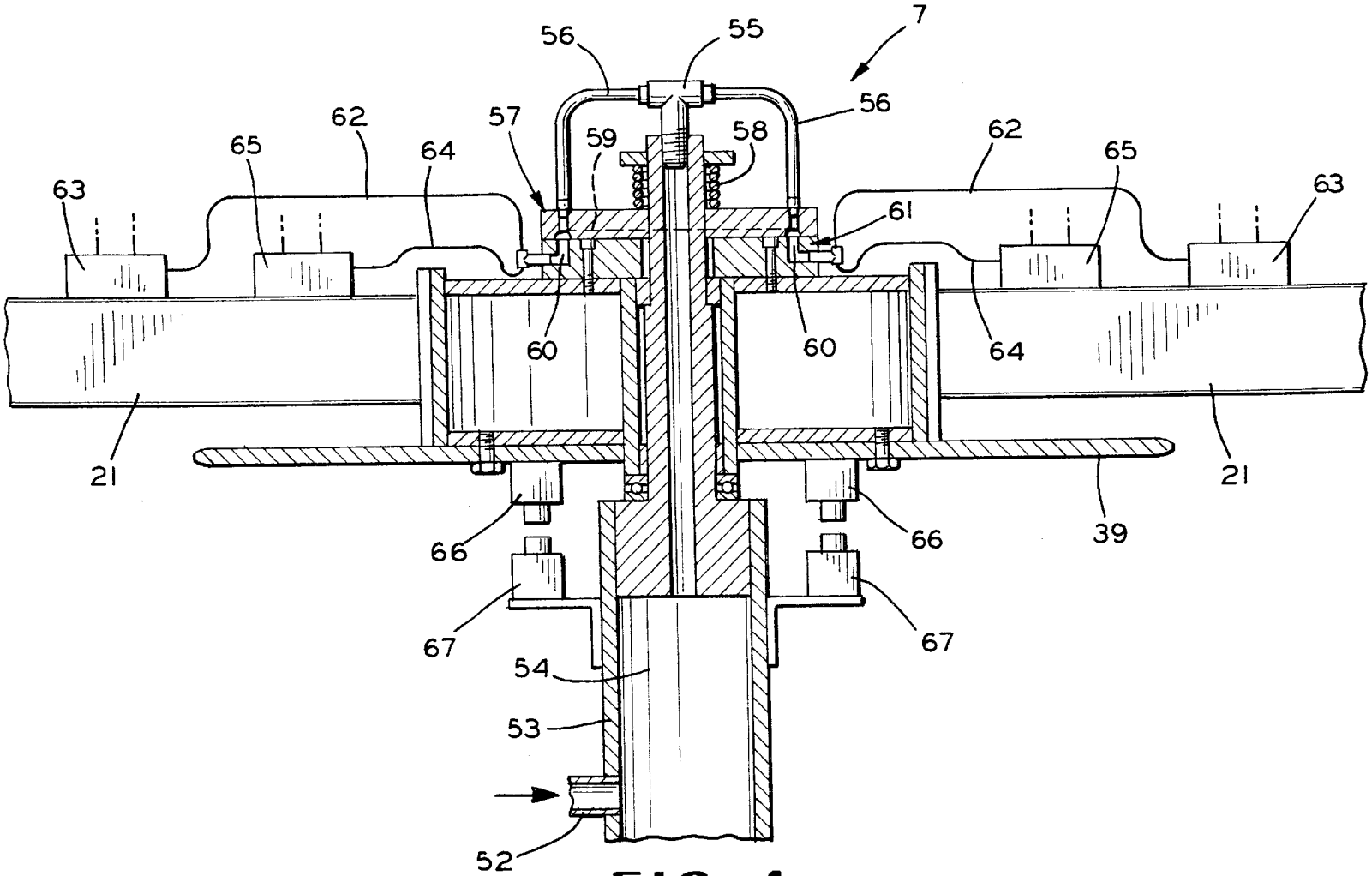
FIG. 4 is a sectional view of the central hub.

FIG. 4 depicts the central support hub 7 and a portion of the fluid distribution system utilized in a preferred embodiment of the invention. For the purposes of this invention, the common usage of the term fluid, which includes both gases and liquids, is intended.

Fluid from a fluid source (not shown) enters the hub 7 through a fitting 52 in a central support member 53 and travels through a conduit 54 in the member 53 to a first "T" 55 in the conduit 54. From the "T" 55, the fluid follows pressure lines 56 to a stationary manifold 57. A plurality of pressure lines 56 are used to ensure sufficient pressure is delivered to the manifold 57. A spring 58 located above the manifold 57 secures the manifold 57 to the hub 7. The manifold 57 is designed with a continuous circular groove 59 around the interior of its circumference. The groove 59 is positioned above a plurality of fluid conduits 60. The conduits 60 are located within a rotating member 61 mounted about the support member 53 and are spaced within the rotating member 61 so as to be aligned with an associated one of the horizontal arms 21. The rotating member 61 is attached to the horizontal arms 21 and, therefore, indexes with the arms 21. As fluid travels through the lines 56 and into the manifold 57, it follows the continuous circular groove 59, thereby dispersing evenly through the manifold 57, and into the plurality of fluid conduits 60. Attached to each of the conduits 60 is a fluid line 62 in communication with a lifting valve 63 and a fluid line 64 for a gripper valve 65. A lifting valve 63 and a gripper valve 65 is attached to each horizontal arm 21. Each lifting valve 63 controls the piston 25 located on the associated arm 21. The gripper valve 65 controls the grippers 3 3 located on the associated arm 21.

A pilot valve 66 is fixed to the sprocket 39 proximate a horizontal arm 21. Preferably, there is a pilot valve 66 located on the underside of the sprocket 39 directly below each of the horizontal arms 2 1. A plurality of electric solenoids 67 are attached around the circumference of the central support hub 53. The solenoids 67 are attached about the circumference of the central support hub 53 so as to correspond with each of the treatment stations. The solenoids 67 engage an associated one of the pilot valves 66 upon receiving a signal from the computer network. The network only actuates the solenoids 67 when provided with a signal from the sensor 50 (FIG. 3) indicating that a horizontal arm 21 is properly located at a station. The pilot valve 66 provides the lifting valve 63 with fluid pressure to the piston 25. The pilot valve 66 also assists the gripper valve 65 to maintain the grippers 33 in gripping contact with the items.

The following is a detailed description of the operation of the acid etching machine 1 of the invention. To simplify the description, one of the plurality of arm assemblies 20 will be described as it transports items through the etching process. In practice, however, it will generally be preferred to utilize each arm assembly 20 to carry items to the respective stations simultaneously.

At the load station 20, a load conveyor 8 supplies the acid etching machine 1 with items loaded on grids (not shown). The grids allow the items to be arranged in the same spaced apart relationship as the array of grippers 33 on the carrier head 29. An arm assembly 20 indexes into position at the load station 2 and the carrier head 29 is lowered over the items until the grippers 33 are positioned opposite the items. The grippers 33 are activated to grip the items. In the preferred embodiment, the grippers 33 are inflated into fluid tight gripping contact with the items. Once secured by the grippers 33, the vertically translatable arm 22 lifts the carrier head 29 and attached items from the grid. The arm assembly 20 then indexes to the first treatment station 9.

Upon reaching the first treatment station 9, the vertically translatable arm 22 automatically lowers the carrier head 29, with the items attached thereto, into the surface treatment removal bath. The surface treatment removal bath removes contaminants on the items which may alter the effectiveness of the etching process. The treatment bath contains, for example, a solution consisting of approximately 40% water, 40% hydrochloric acid (32% concentration) and 20% hydrofluoric acid (70% concentration). The solution is stored in a make-up tank (not shown) near the treatment station 9 and pumping means (not shown) are utilized to transfer the treatment solution from the make-up tank to the station 9.

It is to be understood that the duration of time the items spend in the treatment stations depends upon, among other things, the composition of the glass or ceramic items, the number of the items being treated, the composition of the bath, and the degree of etching desired.

Upon completion of the surface treatment removal, the vertically translatable arm 22 lifts the carrier head 29 and the items from the bath, and the arm assembly 20 then indexes to the third station 10.

In the preferred embodiment, the arm assembly 20 will, upon arrival at each station, automatically lower the items into the station, retain the items in position within the station during treatment, and then raise the items once treatment is complete. The arm assembly 20 will then automatically index the items, preferably in a clockwise direction, to the next station. However, as can be seen from FIG. 1, it is well within the scope of the present invention for the arms to index in a counter-clockwise direction. To simplify the description of the operation of the machine 1, the motion of the arm assembly 20 as described above should be understood to occur at each station unless stated otherwise.

The second station 10 spray washes the items to remove the surface treatment removal solution. Water used during the washing process is preferably recirculated through the washing station 10 with pumping means (not shown). Upon completion of the spray wash, the arm assembly 20 indexes to the third station 11 comprising a pre-etchant conditioning solution.

The conditioning solution at the third station 11 is comprised of, for example, approximately 0.4 pounds of LERITE (a glass frosting material) per gallon of hydrochloric acid (32% concentration). The components of the solution are combined in a make-up tank (not shown) near the treatment station 11. Following the combination, pumping means (not shown) are used to transfer the solution from the make-up tank to the station 11. A venturi-type agitator (not shown) is located in the base of the third station 11 to ensure the LERITE does not precipitate out of the hydrochloric acid. It has been found to be advantageous to provide a second conditioning station (not shown) adjacent to the first conditioning station 11 to ensure the items have been properly conditioned before being etched.

Although this description is in the context of etching glass and ceramic items through the use of a particular etchant solution sold under the trademark LERITE, those skilled in the art will readily understand that the present invention can be applied to etching items with other suitable etchant solutions.

The items are indexed from the conditioning station 23 to the etching stations.

The fourth 3, fifth 4, and sixth 5 stations are etching stations which preferably share a common etchant tank. The etchant solution is comprised of, for example, approximately 55 pounds of LERITE and 2.7 gallons hydrochloric acid (32% concentration) per 7.4 gallons of solution.

The combination of large quantities of LERITE and hydrochloric acid results in a exothermic reaction. Therefore, a mixing tank (not shown) is typically used to combine the two chemicals, and a storage tank (not shown) is used to store the cooled, mixed chemicals. Pumping means (not shown) are used to transfer the etchant from the mixing tank, to the storage tank and then to the etchant bath. A venturi-type agitator (not shown) is located in the base of each etching station to ensure the LERITE does not precipitate out of the hydrochloric acid.

The items remain at the fourth station 3 until the desired degree of etching has been accomplished. The items are then indexed to the fifth 4 and the sixth 5 stations where the same steps are repeated.

The seventh station 12 removes excess etchant adhering to the items by first submerging and then removing the items from a water tank. The water is recirculated through the washing station 12 by pumping means (not shown).

The eighth station 13 provides a bath of an acid solution comprised of, for example, approximately 20% hydrochloric acid (32% concentration) and 80% water. The acid solution removes any remaining etchant adhering to the items. The components of the solution are combined in a make-up tank (not shown) near the treatment station 13 and pumping means (not shown) are used to transfer the solution from the make-up tank to the station 13.

The ninth station 14 removes excess acid adhering to the items by first submerging and then removing the items from a water tank. The water is recirculated through the washing station 14 by pumping means (not shown).

The tenth station 15 comprises a caustic solution for removing resists applied to the surfaces of the items. In the art of glass etching, resists are sometimes used to cover portions of the glass or ceramic item where etching is not desired. However, upon completion of the etching process, the resists are removed. The caustic solution at the tenth station 15 dissolves the resists from the items. The solution is comprised of, for example, approximately 10% sodium hydroxide (50% concentration) and 90% water. The components of the solution are combined in a make-up tank (not shown) near the treatment station 15. Pumping means (not shown) are used to transfer the solution from the make-up tank to the station 15.

The eleventh 16 and twelfth stations 17 include spray washes for removing remaining treatment solutions from the items. The water is separately recirculated through the individual washing stations utilizing pumping means (not shown).

The thirteenth station 18 removes excess water adhering to the items by directing forced air over them. The items remain in the station 18 until the water has been adequately removed.

In the preferred embodiment, an unload station 6 is provided next to the thirteenth station 18. To unload the items, the arm assembly 20 lowers the items onto an unload conveyor 19. The computer network (described above) signals the fluid distribution system to relieve the fluid pressure to the grippers thereby releasing the items from the machine 1.

In accordance with the provisions of the patent statutes, the present invention has been described in what is considered to represent its preferred embodiment, however, it should be noted that the invention can be practiced otherwise than as specifically illustrated and described without departing from its scope or spirit. For example, the number, type, and order of the stations or the various chemical compositions used.

What is claimed is:

1. An automated etching machine for etching glass and ceramic items, comprising:

a plurality of radially extending, individually controlled vertically translatable carrier arms secured to, and rotatable about, a central hub;

a carrier head attached to each of said vertically translatable arms;

a plurality of item grippers attached to each of said carrier heads for securing items to be etched; and a plurality of etching treatment stations circumferentially located about said central hub for etching glass and ceramic items.

2. An automated etching machine as defined in claim 1, further comprising a plurality of horizontal arms connecting said hub to said vertically translatable arms.

3. An automated etching machine as defined in claim 2, wherein said horizontal arms rotate in a horizontal plane about said hub.

4. An automated etching machine as defined in claim 2, wherein each of said horizontal arms is supported for rotation about said hub by a wheel.

5. An automated etching machine as defined in claim 1, further comprising a piston connected to each of said horizontal arms and said vertically translatable arms for providing individually controlled vertical translation to each of said vertically translatable arms.

6. An automated etching machine as defined in claim 1, wherein said vertically translatable arms have parallel upper members and lower members, said upper members and said lower members being connected by a spacer to ensure coordinated vertical translation of said upper and lower members.

7. An automated etching machine as defined in claim 6, wherein said upper members and said lower members are pivotally connected to said horizontal arms and said carrier heads.

8. An automated etching machine as defined in claim 1, further comprising programmable computer controlled drive means for selectively rotating said vertically translatable arms.

9. An automated acid etching machine as defined in claim 1, further comprising computer control means for controlling said vertically translatable carrier arms for independently inserting and retracting said items into said plurality of stations.

10. An automated etching machine as defined in claim 1, wherein said individually controlled vertically translatable arms, said carrier heads and said item grippers are constructed substantially of polypropylene.

11. An automated etching machine as define in claim 1, further comprising a plurality of adaptors secured to each of said vertically translatable carrier heads which secure said item grippers to said carrier heads.

12. An automated etching machine as defined in claim 11, further comprising at least one longitudinal conduit through each of said adaptors capable of distributing fluid from a fluid source to at least one channel within said item grippers.

13. An automated etching machine as defined in claim 1, wherein said treatment stations have slotted roofs to allow said vertically translatable arms to index between said stations.

14. An automated etching machine as defined in claim 1, further comprising:

at least one station for loading said items into an etching machine;

at least one station for etching said items, said etching station having a partially enclosed top to allow said vertically translatable arms to index in and out of said at least one station; and at least one station for unloading said items from said machine.

15. An automated etching machine as defined in claim 14, further comprising:

at least one station for removing contaminants from said items;

at least one station for rinsing said items;

at least one station for exposing said items to a surface conditioning treatment;

at least one station for exposing said items to an acid treatment solution; at least one station for exposing said items to a caustic treatment solution; and at least one station for drying said items with forced air.

* * * * *